United States Patent [19]

Livesey et al.

[11] Patent Number: 4,640,359

[45] Date of Patent: Feb. 3, 1987

[54] BITUMEN PRODUCTION THROUGH A HORIZONTAL WELL

[75] Inventors: Declan B. Livesey, Calgary; Petre Toma, Edmonton, both of Canada

[73] Assignee: Texaco Canada Resources Ltd., Calgary, Canada

[21] Appl. No.: 797,354

[22] Filed: Nov. 12, 1985

[51] Int. Cl.[4] ..... E21B 43/24; E21B 36/00

[52] U.S. Cl. ..... 166/276; 166/303; 166/306; 166/50

[58] Field of Search ..... 166/303, 306, 278, 276, 166/230, 50, 272

[56] References Cited

U.S. PATENT DOCUMENTS

| | | | |
|---|---|---|---|
| 4,460,044 | 7/1984 | Porter | 166/50 |
| 4,480,695 | 11/1984 | Anderson | 166/50 |
| 4,508,172 | 4/1985 | Mims et al. | 166/306 |
| 4,511,000 | 4/1985 | Mims | 166/303 |
| 4,532,994 | 8/1985 | Toma et al. | 166/303 |
| 4,565,245 | 1/1986 | Mims et al. | 166/272 |

*Primary Examiner*—Stephen J. Novosad
*Assistant Examiner*—Bruce M. Kisliuk
*Attorney, Agent, or Firm*—Robert A. Kulason; James J. O'Loughlin; Robert B. Burns

[57] ABSTRACT

Method and apparatus for extracting a viscous hydrocarbon from a productive substrate which is characterized by amounts of unconsolidated sand particles. A hot, thermal stimulating medium is introduced at an elevated pressure to the productive substrate through the remote end of an elongated well liner. As the hydrocarbon becomes mobile it is urged to the lower pressured segment of the liner. An expandable diverter, pervious to the stimulating medium, is positioned in the liner to form a quasi-barrier. Said barrier is progressively lengthened to cause the stimulating medium to penetrate progressively increasing lengths of the productive substrate to assure extraction of hydrocarbon along the entire liner length.

10 Claims, 4 Drawing Figures

BITUMEN PRODUCTION THROUGH A HORIZONTAL WELL

BACKGROUND OF THE INVENTION

This invention relates to an apparatus and method therefor, which includes the deep boring into a formation for the purpose of extracting hydrocarbon fluids from the earth. More specifically, the invention relates to a method for thermally treating a subterranean formation to reduce the viscosity of fluids which are retained in the formation, thereby enhancing the extraction of the hydrocarbons. The latter is achieved through the use of means to control the movement of the thermal treating reaction, to most effectively sweep a productive layer.

The vast majority of heavy oil reservoirs such as tar sand formation, lie 50 meters under the surface of the earth and therefore must be tapped through the use of in situ technology. Examples of heavy oil reservoirs include those located at the Athabasca and Cold Lake regions of Canada. In the United States the Edna and Sisquoqe are located in California as well as in the tar sand triangle in Utah.

The high viscosity of hydrocarbon having a density which is between 10 and 20 API, characterize all the above mentioned deposits and substantially all tar sand reservoirs. The heavy oil found in such reservoirs commonly referred to as bitumen, contained in tar sands, is usually immobile at reservoir temperatures.

In the particular situation of tar sand reservoirs such as in the Athabasca region of Canada, the reservoir temperature is approximately 7° C. The viscosity of the viscous oil is above 1 million centipoises. In such a condition for all practical purposes, the hydrocarbon is considered as being formed of solid matter.

Another important feature of many tar sand reservoirs is the nature of the solid matrix which is generally comprised of a fine, unconsolidated sand with the median between 100 and 200 um containing the heavy, viscous oil.

Attempts to recover heavy oil from a tar sand formation have to deal with at least two major problems. These include the reduction of the oil's viscosity, and the movement of solids such as unconsolidated sands.

One of the most successfully applied practices for recovery of the heavy oil from tar sand is through in situ heating or stimulation.

The efficiency of the heating process is enhanced by the increase of net convection, or the amount of heating fluid which can penetrate the tar sand formation. As a rule, the tar sand's formation is initially saturated with an 80 to 90% high viscosity oil; only 10 to 20% saturated with gases and water.

For most of the tar sand reservoirs and particularly for ones with low and medium temperatures, an initial net convection of the heating fluids into the reservoir cannot be readily determined. Any increasing of the injection pressure of the heating or stimulating fluid carries with it the likelihood of fracturing the reservoir in an undesirable direction out of the tar sand formation. This circumstance is undesirable since the stimulating fluid will be of no further use.

To control the injection of heating fluids into the formation, it has been proposed to drill inclined and/or horizontally deviated wells. The latter will conduct the heating fluids, and/or additives directly into the heavy oil formation.

The present invention provides an improvement in means for producing bitumen and viscous hydrocarbon from tar sand and other formations in which the hydrocarbon is released through thermal stimulation. Examples of such wells are disclosed in U.S. Pat. No. 3,913,672, J. C. Allen et al; U.S. Pat. No. 3,908,762, D. A. Redford. In the methods there taught, naturally occurring high permeability breaks or those formed by means of conventional hydraulic fracturing and propping are proposed as a solution for penetrating the tar sand formation.

A diversified, simultaneous injection-production method can be achieved from a single well as disclosed in U.S. Pat. No. 3,813,671, D. A. Redford et al. This latter concept is further disclosed in U.S. Pat No. 4,088,188, R. H. Widmyer.

In the above described methods, at least one production well is completed to provide a separate path from the surface in order that a treating fluid can be introduced into a portion of an underlying hydrocarbon productive formation. The aqueous heating fluid can be injected into a portion of the formation adjacent to the production well on a timed progress basis. Therefore, continuous injection of the aqueous heating fluid into the formation can also be utilized.

Toward the further production of heavy hydrocarbons from environments such as tar sands, there are known processes which utilize horizontal or long deviated wells to recover heavy oil from tar sands. These however are subject to at least two major drawbacks. The latter include the control of solids, and the open line bypass affect.

A significant problem is usually encountered when dealing with the production of heavy oil from an unconsolidated formation when a long, horizontal or deviated slotted liner is utilized. Briefly, when the liner penetrates clean sand or shale zones, fine sand particles and bitumen which are displaced during the recovery process form a series of flow paths.

A further problem encountered in production from a horizontal well relates to the control of the recovery process when a long inclined or horizontal liner is introduced into the tar sand formation. Injected and produced fluids move in and out of the formation radially under the effects of a huff and puff external action and/or under the effect of condensation and flashing during thermal pumping of steam, a method referred to generally as steam stimulation.

Hot water, liquid additives and multiphase fluids that stay far from saturation, are not moved rapidly as easily as steam condensate which is near saturation. The only way to assure optimum penetration of stimulating liquids and/or gases in mixture, is by backing their injection with pressure. This mechanism is, however, less effective than flashing conduction thermal pumping.

In any tar sand substrate, the desired sweeping effect between the injection and production points along a horizontal well is reduced at a negligible fraction since the permeability to flow of an open line is usually many times higher than the permeability of the formation. Therefore, when hot fluids other than steam are injected, the formation around the previously stimulated liner in a cyclic steam injection, is cooled down. This results since only a very small fraction of fluids will be able to penetrate the formation.

The delicate balance between flow of hot stimulating fluid, and heat transfer, will eventually further reduce the actual flow rate into the formation to a very small insignificant area around the slotted perforated liner.

It is found therefore that if the horizontal well is able to radially distribute the injected steam during the stimulation step a reasonable, positive sweeping process can be maintained along the well. The long horizontal liner will tend to allow the hot fluids to bypass, thereby overriding the formation during axial flow between the injection and producing points along the liner.

There exists therefore an unfilled need for a system which will make a long horizontal or deviated well, into a more effectual system. Further, the well should be capable of better controlling both axial, and radial inflow-outflow of fluids.

In one embodiment of the presently disclosed invention, a highly deviated, or substantially horizontal wellbore is drilled to penetrate a tar sand formation. The wellbore can extend substantially through the center of the formation or along another appropriate level. A network of similar deviated wells of identical construction can be similarly drilled into the formation.

The particular spacing of wells and their arrangement will depend to a large degree on the size and the characteristics of the particular formation. One embodiment of the invention provides more than one well which extends through a substrate and which will penetrate the formation at an inclined alignment. Thereafter it can extend in a substantially horizontal disposition through the hydrocarbon productive layer.

To overcome the aforementioned problems in producing viscous hydrocarbons from a formation and in particular from a tar sand environment, there is presently provided an elongated, perforated well liner which is registered in a wellbore disposed within the subterranean hydrocarbon producing layer. A well head at one end of the liner permits pressured introduction of a stimulating fluid to the substrate.

An elongated fluid conduit is positioned in the liner, extending longitudinally thereof and having a discharge opening adjacent to the liner remote end. A diverter bed of randomly disposed metallic fibers surrounds a portion of said conduit to form a variable length, quasi-penetrable barrier in the liner. The diverter thereby segregates or separates the liner into injection and production segments or compartments. The barrier bed is progressively lengthened as the process proceeds whereby to assure a thorough thermal sweep of the formation along the well liner.

It is an object of the invention therefore to provide an improved means and method for producing hydrocarbon fluids from a substrate that requires thermal stimulation. A further object is to provide a well completion which is capable of providing an efficient sweep of the surrounding substrate by controlled introduction of stimulating fluid to the latter. A still further object is to provide a well completion in which a variable length diverter or quasi-barrier is utilized to most effectively distribute a hot stimulating fluid into the substrate whereby to provide a more efficient outflow of a hydrocarbon aqueous emulsion.

Figure 1:
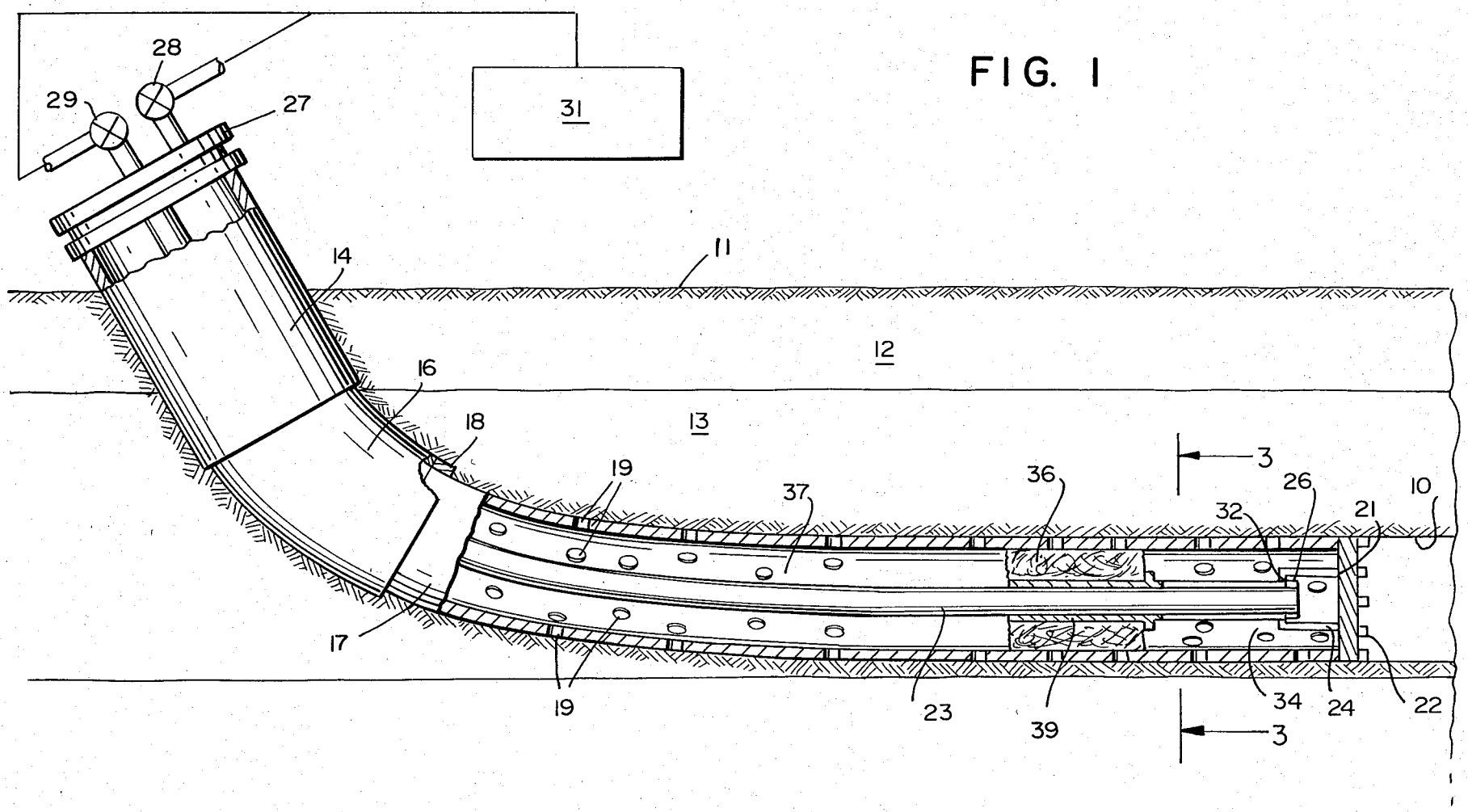
FIG. 1 is an elevation view in partial cross-section of a well of the type contemplated.

In achieving the foregoing objectives, there is presently provided a method of producing from, and a well completion which is used in a substrate or layer which releasably holds a hydrocarbon fluid. An example of the latter comprises a tar sand type of environment wherein a hydrocarbon such as bitumen is releasably held within a mass of unconsolidated sand particles.

Referring to the drawings, a wellbore 10 of the type contemplated is shown which enters the ground vertically, or preferably at an angle to the surface 11. Wellbore 10 is initially spudded through the overburden 12 which overlies the productive or tar sand layer 13.

Thereafter, partway through overburden layer 12, bore 10 is deviated in a manner that at least a segment of it lies in a generally horizontal relationship with respect to hydrocarbon productive layer 13, as well as to the earth's surface 11. Further, the well's horizontal segment is preferably positioned at a depth to be adjacent to the lower border of the generally horizontal layer 13. Following the usual drilling practice, wellbore 10 is provided at its upper end with a series of casing lengths 14 and 16, which are affixed in place by cementing means.

An elongated well liner 17 is inserted through the respective casings 14 and 16, and is supported in casing 16 by a liner hanger 18. The latter is structured to permit passage of bitumen emulsion and/or hot stimulating fluid therethrough during the producing or the injection stages of the operation. Liner 17 can be provided at its forward or remote end with means to facilitate its being slidably inserted into and along the wall of wellbore 10.

Structurally, liner 17 comprises a steel, pipe-like member being perforated as required along that portion of its wall which lies within tar sand layer 13. The perforations can take the form of a series of holes 19 formed through the liner wall. Alternately they can comprise slotted openings which extend either longitudinally or peripherally about the liner. Further, said perforations can be formed either before or after liner 17 is inserted into borehole 10 to perform their function.

In any event, liner openings or perforations 19 are adequate to allow the discharge of pressurized heating medium therethrough and into the adjacent tar sand containing substrate 13. Further, they allow the return flow or the entry of a hot, aqueous bitumen mixture through the same wall openings after said mixture achieves a flowable state.

In one embodiment, the forward or remote end of liner 17 is provided with a panel or plate 21 which defines a substantial barrier and partial closure to the end of the liner. Said panel means is disposed normal to the longitudinal axis of the liner and fastened in place by peripherally arranged screws, bolts, or like fastening means 22.

An elongated, fluid carrying conductor or conduit 23 is disposed internally of liner 17. Said conductor can rest on the liner inner wall and is preferably fixed at its remote end by clamping means 24 which engages flange 26 at the conduit open end.

Conductor 23 is constructed of continuous tubing or alternately of pipe lengths which are interconnected end to end at smooth connecting joints. Conduit 23 is capable of carrying a pressurized stream of hot stimulating fluid such as steam, hot water, or either of said elements having appropriate chemicals intermixed therewith to facilitate the producing process. The condition of the injected fluid will depend to a large extent on the composition and character of the substrate 13.

The upper external ends of the respective liner 17 and conductor 23 are provided with a normal closure means such as a well head 27. The latter, generally includes regulating valves 28 and 29 which are operable to permit selective and controlled communication of the individual liner 17 passages with a source of stimulating fluid 31.

Conductor 23 is by and large unsupported along its length in the liner 17. However, the remote end of the conductor as noted is fixed in place adjacent panel 21 which forms a closure to the liner end.

As seen in FIG. 1, panel 21 is provided with a split, multi-component bracket 24 which depends from the panel inner face. Said bracket 24 includes an in-turned rim 32 which is adapted along its face to engage a flange 26 formed about the periphery of conduit 23. Thus, as a pressurized hot stimulating fluid is discharged from the open end of conduit 23, it will be free to fill the injection chamber 34 and thereafter to penetrate the surrounding formation by way of perforation 19.

Figure 2:
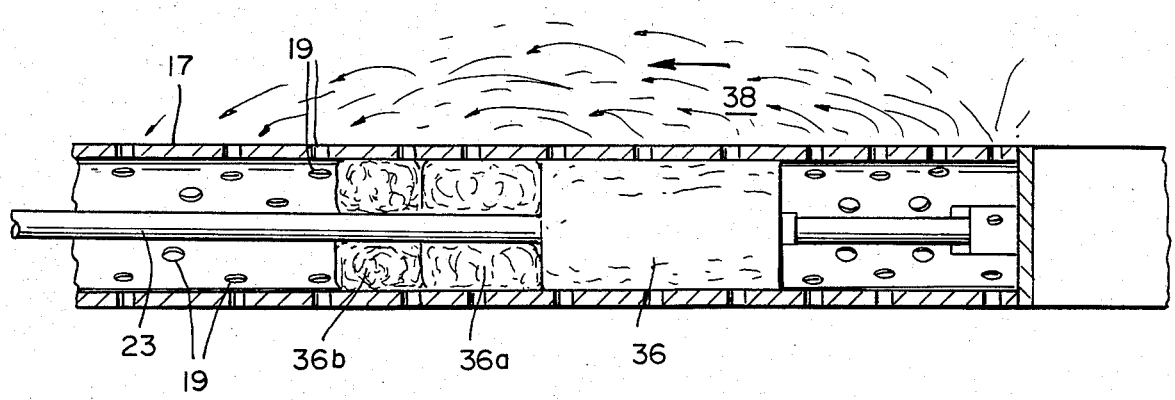
FIG. 2 is a schematic, segmentary view of the well shown in FIG. 1.

Referring to FIGS. 1 and 2, conduit 23 is provided for part of its overall length with an enclosing flow diverter 36. Said diverter is comprised of a series of individual filter-like diverter units **36*a* and 36*b* which are disposed contiguous with or in close contact with each other within liner 17. Diverter 36 functions as a quasi-barrier to direct a stimulant such as steam from the injection chamber 34**, and into the surrounding substrate adjacent to the liner.

As hereinafter noted, diverter 36 will pass limited minor amounts of the steam, while urging the major portion thereof into the formation.

Over a period of operating time, the hot pressurized steam will penetrate the formation 13 along liner 17 to soften retained bitumen. It will further cause a bitumen-water emulsion to form. This latter emulsion under the built-up pressure within the formation will not only penetrate the tar sand and soften the bitumen, but will gravitate toward the lower pressure producing compartment 37 of liner 17.

Referring to FIG. 2, as the bitumen emulsion is urged by built up pressure toward liner 17, it will establish a series, or network of flow paths 38. The latter are created by voids in the tar sand which result from evacuation of the retained bitumen. After a sustained period of bitumen emulsion production, the stimulating steam will pass directly through the established flow paths 38. It will thereafter flow directly into production segment 37 and out well head 27, thereby minimizing the effectiveness of the steam.

It is necessary at this phase of the operation to alter and extend the established flow paths 38 so that they penetrate the formation closer to the liner well head 27. This is achieved by lengthening diverter 36, whereby to preserve the length and the volume of injection compartment 34, and to concurrently reduce the length and volume of the production segment 37.

This alteration in operating conditions is effectuated by positioning additional diverter units as **36*a*, adjacent to the original diverter member 36. Thus, the latter will extend overall for a greater distance, and along liner 17 toward well head 27**.

Figure 3:
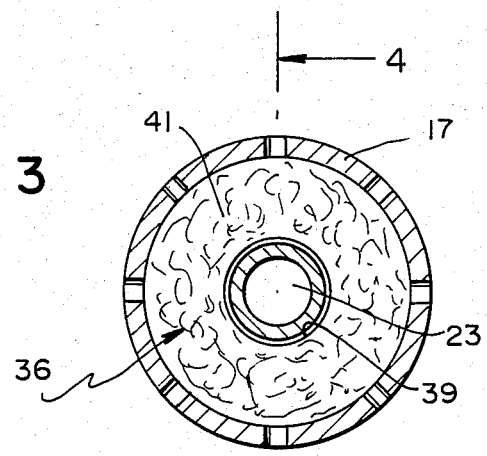
FIG. 3 is a cross-sectional view taken along line 3—3 of FIG. 1.
Figure 4:
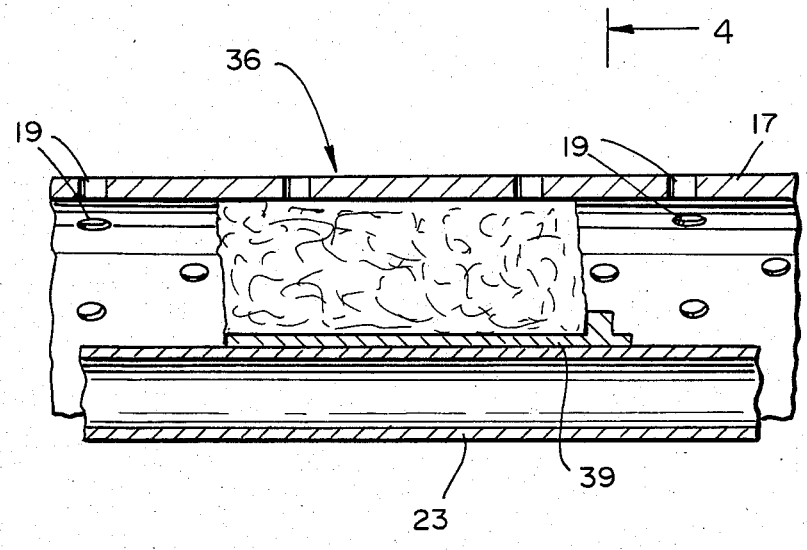
FIG. 4 is a segmentary view on an enlarged scale of a portion of FIG. 1.

In the embodiment of FIGS. 1 and 3, the diverter is comprised of a series of cylindrical units having a central opening 39 which is capable of slidably registering onto the conductor 23. As each successive diverter unit is applied to the upper end of conductor 23, it is urged downwardly along the wall of liner 17, and into direct contact with the diverter units already in place.

The extended diverter will accomplish two purposes. First, because of its quasi-pervious nature, it will cause most of the stimulating steam to pass from injection segment 34, into the formation 13. Secondly, since the diverter is in contact with the liner 17 walls, it functions as a detriment to passage of bitumen emulsion which might flow toward the diverter-occupied portion of liner 17. Stimulating steam will thereby tend to extend flow paths 38 toward the liner production segment 37.

Each diverter 36 section is comprised of a cylindrical shaped mass or body 41 of randomly disposed metallic fibers or fibrules. The fibers are compacted and maintained in place onto a core piece 41 to achieve a predetermined density. Thus, the passages defined between the compressed fibers will form a quasi-barrier to thermal stimulating medium whereby to throttle, and not entirely prevent the flow of said heating medium into and through the diverter.

As seen in FIG. 1, the diverter 36 outside diameter is sufficient to be slidably received not only along central conduit 23, but also along the inner wall of liner 17. Thus, as the respective diverter sections **36*a*, 36*b*, etc. are sequentially urged into contact with the previously positioned diverter, the aggregate unit will substantially fill the annulus defined between the inner wall of liner 17 and conduit 23**.

Each diverter unit as noted is basically cylindrical in configuration. This shape, however, is provided to most readily accommodate the open annular passage defined between the adjacent liner 17 and central conduit 13. Further, while the compacted fibrous mass is such as to provide a desired density, the overall mass is nonetheless yieldable to permit slidable insertion into the liner 17 as above noted.

Structurally, diverter 36 is formed and fabricated to a desired shape, and to remain substantially the same shape under expected operating conditions of high temperature and pressure. The random fibers are therefore comprised of a temperature resistant metal such as steel, and preferably stainless steel. Similarly, when an internal core or sleeve 39 is utilized, it, too, is fabricated of steel to afford structural integrity. A diverter barrier formed as described herein will be capable of resisting thermal deformation and loss of efficiency even under most arduous thermal stimulating conditions.

Operationally, diverter 36 is preferably fixedly assembled onto conduit 23 at the time the latter is initially registered in and connected to liner 17. As herein noted, the remote end of conductor 23 is connected by means of flange 26 and its mating bracket 24 on panel 21 to properly position the conduit.

With diverter 36 fabricated to a desired length and initially positioned on conduit 23, the latter, together with liner 17, are inserted as a unit into a borehole 10. Thereafter as production of bitumen proceeds as herein noted, the outflow of bitumen emulsion will normally vary as a function of the volume and quality of steam which is injected into the formation.

After a period of operation, the stimulating steam will tend to follow the flow paths 38 and enter liner 17, thereby avoiding the extension of said flow paths into the areas from which additional bitumen emulsion can be produced. This phenomenon will be noted at well head 27 by monitoring the amount of steam which is produced.

When it becomes apparent that an excessive amount of steam is exiting from the liner, diverter 36 will be extended to in effect maintain the size of the injection segment 34 in the liner, which reducing the volume of the production segment 37.

This is achieved as herein noted by positioning one or more additional diverter segments 36*a* and 36*b* onto conduit 23. The diverter sections can be urged downwardly and guided by conduit 23 into contact with the initially placed diverter 36.

The number of diverter segments so added is sufficient to extend the length of the overall diverter 36 and reduce the volume of producing segment 37 thereby permitting the formation of new flow paths as extensions of the originally formed flow paths 38.

The additional diverter segments can be positioned in any one of a number of ways whereby the aggregate diverter 36 will be comprised of a series of continuously disposed diverter segments. They can, for example, be propelled or urged along conduit 23 by any means appropriate to the operation. Such a means can, for example, comprise one or more elongated, retractable push rods.

Further, the packing of the filter mass of the added diverter segments can be designed to achieve a desired density. This will allow the steam penetration into the barrier to be regulated.

With the now extended diverter in place, the initial operation of injecting stimulating steam through conduit 23 can be resumed. As herein noted, the steam rather than entering liner 17 along that section of liner 17 which encloses the diverter, will tend to bypass said section and allow the bitumen emulsion to enter the shortened production segment 37.

Although modifications and variations of the invention may be made without departing from the spirit and scope thereof, only such limitations should be imposed as are indicated in the appended claims.

We claim:

1. Method for thermal stimulation and production of a viscous hydrocarbon from a reservoir having a productive layer which retains the hydrocarbon until the latter is made flowable by contact with a hot stimulating medium, which method includes the steps of;

forming a borehole having a substantially horizontal segment which transverses the productive layer, registering a well completion in said borehole which includes;

an elongated perforate well liner, a fluid conduit extending through said liner and having a discharge end, and a well head at the liner upper end communicated with said fluid conduit, positioning a variable length flow diverter in said liner adjacent to the fluid conduit discharge end, whereby to define a quasi-barrier in said liner which is pervious to passage of the hot stimulating medium, and which divides the liner into injection and production segments respectively, heating the productive layer about the substantially horizontal segment of said elongated liner, introducing a pressurized stream of the hot stimulant through said fluid conduit and into the liner injection segment, and producing hydrocarbon emulsion which flows into the liner production segment, progressively extending the length of the variable length flow diverter to maintain the volume of the liner injection segment, and to concurrently decrease the volume of the liner production segment.

2. In the method as defined in claim 1, including the step of lengthening said variable length flow diverter by registering additional sections of said fluid pervious metallic beds thereto whereby said liner production segment is progressively shortened with the addition of each diverter section.

3. In the method as defined in claim 1, wherein said variable length flow diverter comprises a plurality of diverter beds formed of randomly disposed metallic fibers which are compressed to achieve a non-uniform density sufficient to form said quasi-barrier to hot stimulant flow.

4. In the method as defined in claim 1, wherein said variable length flow diverter is positioned about the upper end of said fluid conduit, and slidably therealong to define said quasi-barrier to hot stimulant in said liner.

5. In the method as defined in claim 1, wherein the length of said variable length flow diverter is progressively extended by slidably registering additional flow diverter beds on said fluid conduit, and slidably inserting said beds into the liner whereby to engage the previously positioned flow diverter section, said additional beds having a lesser bed density than the original bed.

6. The combination with a well completion for a borehole formed in a generally horizontal disposition into a formation having a hydrocarbon productive layer comprised at least in part of sand particles which retain the said hydrocarbon in viscous form of;

a liner registered in said generally horizontal borehole having a perforated wall, and a well head, and a remote end, a fluid carrying conduit in said liner communicated to a source of a hot stimulating fluid and with said well head, and having a discharge opening adjacent to the liner remote end for conducting a hot stimulating fluid flow to said liner remote end, a variable length flow diverter bed positioned on said fluid carrying conduit to define a quasi-barrier to passage of said fluid therethrough, whereby to permit a limited flow of stimulating fluid into said barrier while diverting a major portion thereof through the liner perforated wall and into the hydrocarbon productive layer.

7. In the combination as defined in claim 6, wherein said variable length flow diverter comprises at least one bed formed of randomly disposed metallic fibers compressed to a desired density.

8. In the combination as defined in claim 7, wherein said variable length flow diverter comprises a plurality of adjacently positioned diverter sections.

9. In the combination as defined in claim 8, wherein the plurality of flow diverter sections define a uniform density quasi-barrier to flow of stimulating fluid.

10. In the combination as defined in claim 8, wherein the plurality of flow diverter sections define a non-uniform density quasi-barrier to fluid flow.

* * * * *